United States Patent [19]

Mikulecky

[11] Patent Number: 4,550,298

[45] Date of Patent: Oct. 29, 1985

[54] TRIP ASSEMBLY FOR A CIRCUIT BREAKER

[75] Inventor: Harvey W. Mikulecky, Oconomowoc, Wis.

[73] Assignee: RTE Corporation, Waukesha, Wis.

[21] Appl. No.: 572,913

[22] Filed: Jan. 23, 1984

[51] Int. Cl.[4] ..... H01H 75/12

[52] U.S. Cl. ..... 335/35; 335/37; 361/37

[58] Field of Search ..... 335/37, 38, 35, 208; 361/37

[56] References Cited

U.S. PATENT DOCUMENTS 3,750,064 7/1973 Kato et al. ..... 335/208
4,435,690 3/1984 Link et al. ..... 335/37
4,454,491 6/1984 Martus ..... 335/208

FOREIGN PATENT DOCUMENTS 2505085 11/1982 France ..... 335/208

*Primary Examiner*—George Harris
*Attorney, Agent, or Firm*—Ronald E. Barry

[57] ABSTRACT

A temperature-responsive trip assembly for a primary circuit breaker, the assembly including a permanent magnet member biased to a circuit opening position and pertinent to engage a thermally-responsive metallic element having a predetermined Curie temperature, the element being formed of a nickel-iron alloy having approximately 32% nickel and being arranged in edge-abutting relation to the magnet.

13 Claims, 7 Drawing Figures

TRIP ASSEMBLY FOR A CIRCUIT BREAKER

BACKGROUND OF THE INVENTION

Overcurrent protective devices required for the tripping of a transformer circuit breaker must have a relatively wide range of response so as to be capable of responding to slight overcurrent conditions and still be capable of withstanding relatively high currents for a short time when major faults occur. For instance, a primary breaker might be called on to interrupt currents as low as 5–10 amperes and still must withstand primary fault currents of 1500–2000 amperes for 10–100 milliseconds. The overcurrent sensor should respond both to the transformer oil ambient temperature and current flow through the device. In my co-pending application Ser. No. 371,776, filed Apr. 26, 1982, and entitled, "Primary Circuit Breaker," which is now U.S. Pat. No. 4,435,690 a primary circuit breaker was disclosed which was connected to the primary winding of the transformer and to interrupt the primary circuit under both fault current and overload conditions. The circuit breaker was provided with a temperature sensing device which responds to an increase in temperature due to a fault current in the primary circuit, as well as an increase in temperature of the insulating oil due to overloading or incipient faults. Although the circuit breaker has performed satisfactorily for its intended purpose, it has been found desirable to obtain a more accurate circuit breaker temperature responsive device to control the response characteristic of the circuit breaker.

SUMMARY OF THE INVENTION

In the present application, a temperature responsive magnetic control switch is disclosed which combines a permanent magnet with a special low Curie temperature alloy metal to maintain a spring loaded latch in a proper position for normal current carrying operation of the circuit breaker. This special alloy metal element will respond to a temperature rise, either due to direct current flow through the element and thus heating, or to the surrounding ambient temperature of the transformer oil. We have found that a special alloy can be made to respond to predetermined temperatures at which the magnetic permeability of the alloy is nearly completely gone, thus releasing the magnet and the latch.

In the preferred embodiment, a nickel-iron alloy having about 32% nickel is used for the element. It provides a very positive reponse to changes in temperature conditions, whether such changes are due to overcurrent or high ambient temperatures related to overloading of the transformer.

IN THE DRAWINGS

FIG. 1 is side elevation section view of a primary circuit breaker of the type contemplated herein, FIG. 2 is a perspective view of one form of the temperature control element, FIG. 3 is a perspective view of another form of the temperature control element, FIG. 4 is another perspective view of another form of the temperature control element, FIG. 5 is a perspective view of another form of a temperature control element.

DESCRIPTION OF THE INVENTION

Figure 1:
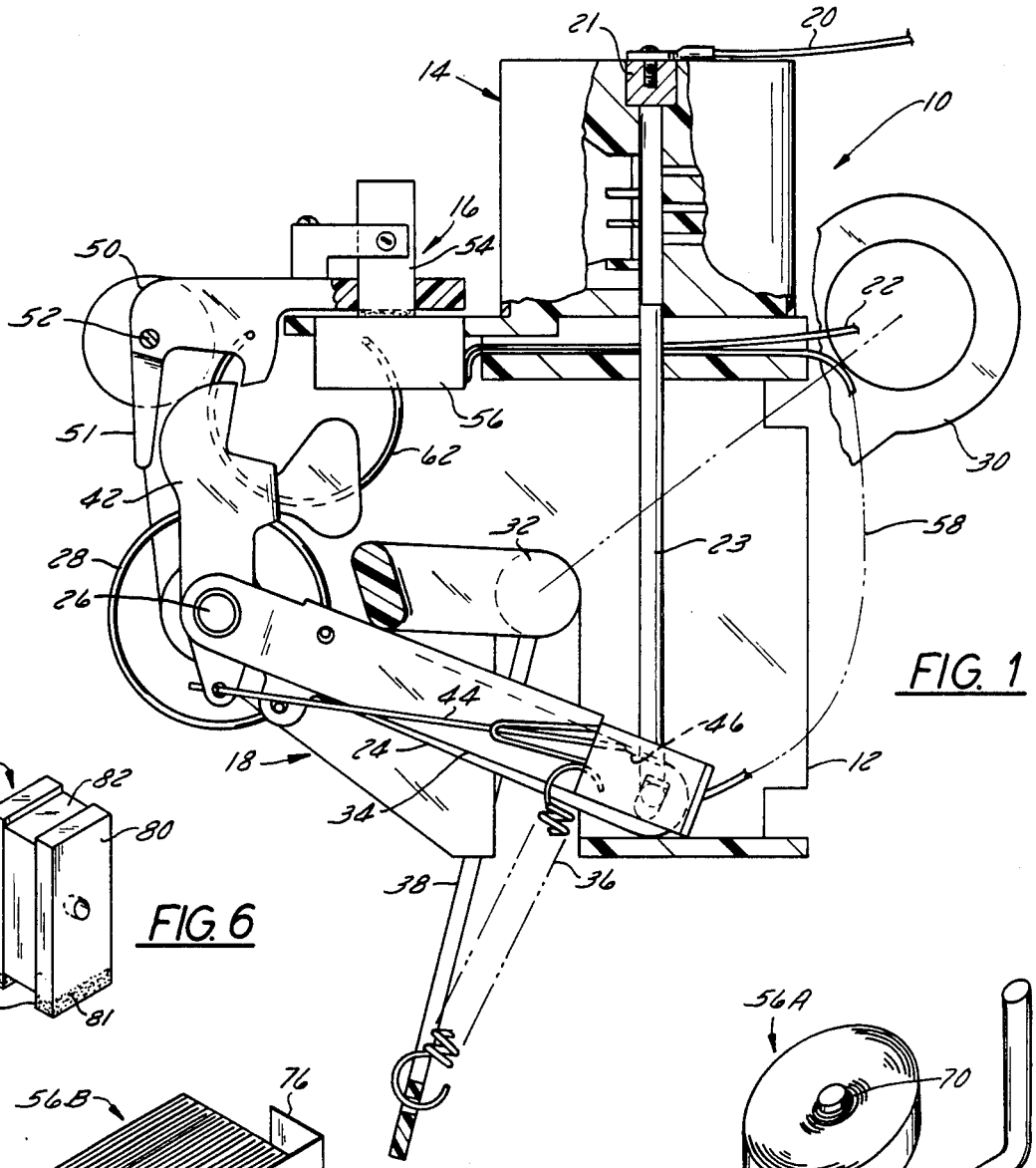

The primary circuit breaker 10 of the type contemplated herein, as shown in FIG. 1, generally includes a frame or base 12, an arc extinguishing assembly 14, a temperature responsive trip assembly 16 and a latch assembly 18. The circuit breaker is connected in series with the transformer primary winding by a conductor 22 and to a power source by a conductor 20. The conductor 20 is connected to a fixed contact 21 provided in the arc extinguishing assembly 14. The primary circuit is open and closed by means of a conductive rod 23 connected to the conductor 58 and mounted for movement into engagement with contact 21 located in the assembly 14. The rod 23 is connected to one end of a lever arm 24 which is pivotally mounted on a pin 26 in the frame 12 and normally biased by means of a spring 28 to an open position as seen in FIG. 1. A second U-shaped lever arm 34 straddles the first lever arm 24 and is also pivotally mounted on pin 26.

The circuit breaker is manually opened and closed by means of an operating handle 30 connected to a crank shaft 32 pivotally mounted in the frame 12. The second operating arm 34 is biased by means of a spring 36 connected to a yoke 38 mounted on the crank shaft 32 to move the conductive rod 23 to the open or closed position. In this regard, the yoke 38 is shown in a position to bias the arm 34 to the open position. Clockwise rotation of the operating handle 30 will rotate the yoke 38 to a position above the pivot point 26 reversing the bias of the spring 36 on the second operating arm 34 so that it moves in a direction to close the conductive rod 23 against the fixed contact 21.

Means are provided for connecting the operating arm 34 to the first operating arm 24 so that the conductive rod 23 moves with the second operating arm 34 in the contact close motion. Such means is in the form of the latch assembly 18 which includes a trip lever 42 pivotally mounted on the pin 26. The trip lever is connected to the first operating arm 24 by means of a rod 44 which passes through an opening in the second operating arm 34 and engages a flange 46 provided on the first operating arm 24. Pivotal movement of the second operating lever 34 in th counterclockwise direction will be transferred to the first operating lever 24 by means of the rod 44 so that the conductive rod 23 will move into engagement with the fixed contac 21. If the rod 44 is moved out of engagement with the flange 46, the spring 28 will bias the rod 23 to the open position.

In accordance with the invention, release of the latch assembly 18 is controlled by means of the trip assembly 16. This assembly basically includes a bell crank 50 mounted for pivotal movement on a pin 52, a magnet member 54 supported on the bell crank 50 and a temperature responsive element 56 mounted on the frame 12. The element 56 is connected in series with the conductive rod 23 by means of the conductor 22 and the second conductor 58. The bell crank 50 is biased by means of a spring 62 to the latch release position wherein the actuating arm 51 of the bell crank will engage the trip lever 42 to move rod 44 away from latch 46. The bell crank 50 is held in the inoperative position by the magnetic force of the magnet member 54 and the element 56 against the bias of the spring 62.

As described in my co-pending application Ser. No. 371,776, the combination of a magnet and a low Curie temperature element to control the release of the latch assembly 18 had been contemplated as a means of operating the circuit breaker. However, it has been found that a very precise temperature control can be achieved using a nickel-alloy element 56 and the magnet member 54. It is generally understood that magnetic saturation of these alloys decreases with increase in temperature. That is, thermal agitation in the metallic latice disrupts the alignment of atomic moments in the element, effectively reducing the intensity of magnetization until the Curie temperature is reached at which point the atomic moments become randomly oriented neutralizing the magnetic force of the magnet. In tests which have been conducted using a nickel-iron alloy, specifically 32.3% nickel, the effective Curie temperature can be set at temperatures up to 200° C. It should be understood that the actual trip-out temperature will depend on a balance of the actual forces and weights of the parts. The nickel-alloy is referred to as alloy 32 low Curie temperature material.

The second criteria for the element 56, since it is part of the electrical circuit, is the insulation for the element. This insulation 57 should be of a minimum thickness as practical in order to optimize the space required for the metal element and yet provide the slight insulation require for the low voltage (due to the current flow) between adjacent parts. The thickness of the insulation should be minimized because it acts as an air gap in the magnetic flux circuit which can greatly reduce the holding force. It has been found that by using a teflon coating baked onto the element, the insulation can be held to 2 mil to 3 mil thickness. A polyester coating has also been found effective, having a thickness of 1 mil. The coating must be 100% on the sides and edges of the element to prevent shorting out of currents due to the touching of the magnet member 54. The insulating coating also acts as a thermal heat transfer barrier for short time high current heating of the element and this prevents the magnet member from acting as a heat sink and changing the time current characteristic.

Figure 6:
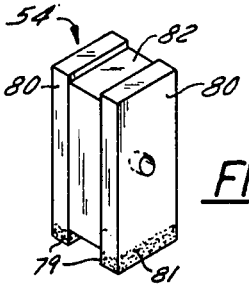
FIG. 6 is a perspective view of the magnet member.

Another consideration in the selection of the trip assembly is the type of magnet member 54 which is most compatible with the temperature responsive elements 56. As seen in FIG. 6 of the drawings, the magnet member 54 includes a pair of pole pieces 80 mounted on each end of a ceramic permanent magnet 82 to direct the flux to the element 56. The ends 79 of the pole pieces 80, should extend beyond the magnet 56 in a position to engage the element 56 when the magnet member 54 is in the latched position so as to provide a maximum holding force under normal operation. The ceramic magnet 82 is made from a ferrite type material. A ceramic was selected because it has physical properties very similar to porcelain and has a high intrinsic coercive force, and an ability to withstand any type of demagnetizing force. The lower ends of the pole pieces 80 are coated with a coating 81 of insulation as described above of varnish to prevent shorting on engagement with the element 56. The pole pieces 80 may also be made of the alloy 32 low Curie temperature material used for the element 56. If the pole pieces are made of the alloy 32 material, the trip-out temperature under secondary fault conditions can be lowered to provide an earlier release of the magnet.

Figure 7:
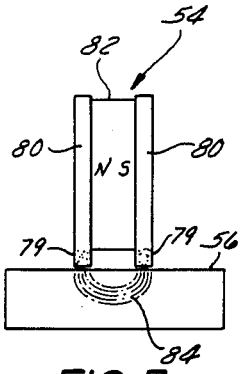
FIG. 7 is an end view of the magnet member showing the flux lines passing through the low temperature element.

In order to obtain a maximum holding force between the element 56 and member 54, consideration must be given to the effective flux penetration of the element. It has been determined that the effective flux penetration of the element is between $\frac{1}{8}$ and 3/16 inches. Any additional thickness of the element 56 has little effect on the holding force of the magnet. This can be seen in FIG. 7, where the magnet member 54 is shown in close proximity to the element 56 separated only by the insulating coatings 81 on the pole pieces and the insulation on the element 56. The magnetic flux lines 84 are shown passing through the effective portion of the total thickness of the element 56.

Figure 2:
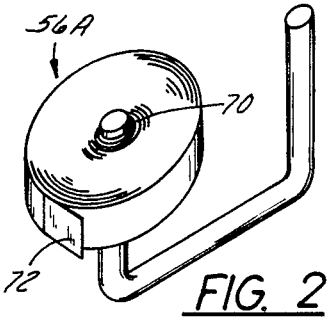

Once the above parameters were determined, a number of configurations for the element were made and effectively used. In the first embodiment, shown in FIG. 2, the element 56A, a thin nickel-iron alloy strip, having a coating of insulation covering the surface of the strip, was wrapped in the form of a spiral with one terminal 70 at the center and the other terminal 72 at the outside. This arrangement presented the edge of the strip to the flux of the magnet with only two air gaps per flux line. It is important that the edge of the strip be held flat to the magnet for maximum coupling of the flux.

Figure 3:
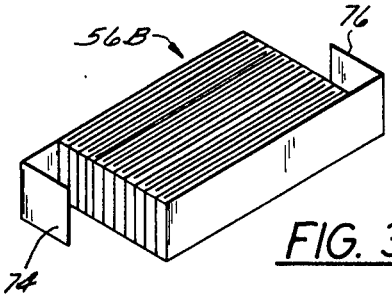

In FIG. 3, an alternate element 56B is shown wherein a strip of insulated nickel-iron alloy was folded on edge back and forth to form a rectangular shape having a terminal 74 at one end and a terminal 76 at the other. The edges of the strip were held flat to the surface of the magnet member 54 to obtain maximum holding force.

Figure 4:
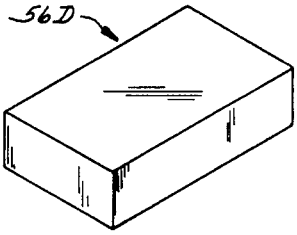
Figure 5:
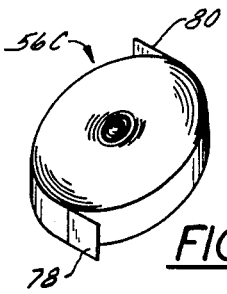

FIG. 5 is another embodiment of the element 56C wherein a strip of insulated nickel-iron alloy was folded in half and spirally wound with the terminals 78 and 80 on the outside of the spiral. The strip is initially folded in half and then spirally wound to provide terminals 78 and 80 on the outer surface of the spiral. It should be noted that the edges of the strip are flat to the surface of the magnet.

Where very high ampere ratings are anticipated, a single solid nickel-iron alloy element 56D could be used, as shown in FIG. 4. Terminals can be provided at each end of the element for connection to the primary circuit.

With any of the above arrangements, the primary circuit trip-out time will be determined by the time required to heat the element 56 under primary fault current conditions. However, the secondary fault time characteristics can be varied, depending on the configuration of the element and the magnet member as well as the cooling rate of the element. In this regard, the element can be cooled to delay heating by providing an oil flow system around the element 56 to delay heat build-up in the element 56 to raise the long-time trip current characteristic of the circuit breaker. This can be achieved by providing small spacings between the adjacent folds of the element or perforations in the box supporting the element 56.

The embodiments of the invention in which an exclusive property or privilege is claimed, are defined as follows:

1. In a fluid immersible primary circuit breaker which is responsive to fault and overload conditions in a fluid filled electrical apparatus, said breaker including a frame adapted to be mounted in the fluid in the apparatus, a first contact mounted on said frame, a second contact mounted for movement into and out of engagement with said first contact, a first spring assembly connected to bias said second contact away from said first contact, a second spring assembly movable between a first position biasing said second contact into engagement with said first contact and a second position biasing said second contact away from said first contact, a latch operably connecting said second spring assembly to said first spring assembly whereby said second contact responds to the position of said second spring assembly, the improvement comprising a temperature responsive trip assembly for releasing said latch from said first spring assembly, said trip assembly includes a magnet member and a nickel-iron alloy element having a predetermined Curie temperature whereby said first spring assembly will move said second contact away from said first contact in response to a fault or overload condition.

2. The trip assembly according to claim 1 wherein said element has a nickel content of approximately 32%.

3. The trip assembly according to claim 1 or 2 wherein said element is formed from a single block.

4. The trip assembly according to claim 1 or 2 wherein said element is formed from a strip of material arranged for edge engagement by the magnet member.

5. The trip assembly according to claim 4 wherein said strip is wound in a spiral having on lead at the center of the spiral and the other lead on the outside of the spiral.

6. The trip assembly according to claim 4 wherein said strip is folded back and forth to form a rectangular shape having a flat surface to engage the magnet member and a terminal at each end.

7. The trip assembly according to claim 5 or 6 wherein said strip is coated with an insulation prior to winding.

8. The trip assembly according to claim 1 or 2 wherein said magnet member includes a magnet and a pair of pole pieces, said pole pieces being mounted on the ends of said magnet.

9. The trip assembly according to claim 8 including a coating of insulation on the portion of the surface of pole pieces adjacent the element.

10. The trip assembly according to claim 1 or 2 including a coating of insulation on said element.

11. A heat responsive element adapted to be connected in the primary circuit of an oil immersible primary circuit breaker having no magnetically controlled trip means, said element comprising an electrically conductive strip formed from a nickel-iron alloy having a nickel content of approximately 32% and an insulating coating covering the entire outer surface of said strip, said strip being arranged in overlapping relationship whereby said insulating coating acts as a thermal barrier between the overlapping of said strip.

12. The element according to claim 11 wherein said strip is wound in a spiral and arranged for edge engagement with the magnet member.

13. The element according to claim 11 wherein the strip is folded back and forth to form a rectangle with the edge of the strip arranged for engagement by the magnet member.

* * * * *